US006556684B1

(12) United States Patent
Macey

(10) Patent No.: US 6,556,684 B1
(45) **Date of Patent: *Apr. 29, 2003**

(54) SPA AUDIO SYSTEM

(75) Inventor: Steve S. Macey, Oceanside, CA (US)

(73) Assignee: Watkins Manufacturing Corporation, Vista, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/516,132

(22) Filed: Mar. 1, 2000

(51) Int. Cl.[7] ..... H04R 1/02; H04R 25/00; H04R 5/02; H04H 5/00

(52) U.S. Cl. ..... 381/89; 381/189; 381/300; 381/2

(58) Field of Search ..... 381/89, 150, 189, 381/300, 301, 334, 2

(56) References Cited

U.S. PATENT DOCUMENTS

| | | | | |
|---|---|---|---|---|
| 3,590,382 A | * | 6/1971 | Kenney | 325/36 |
| 4,757,548 A | | 7/1988 | Fenner, Jr. | 381/189 |
| 5,473,700 A | | 12/1995 | Fenner, Jr. | 381/90 |
| 6,332,029 B1 | * | 12/2001 | Azima et al. | 381/152 |

OTHER PUBLICATIONS

Clark Synthesis Tactile Sound, Installation and Operation Guide, 1997, Clark Synthesis, Inc., p. 6.*

* cited by examiner

*Primary Examiner*—Forester W. Isen
*Assistant Examiner*—Elizabeth McChesney

(57) ABSTRACT

A portable spa including an audio system designed to use the spa shell as the sound generating device. Transducer devices are mounted within an enclosure which is bonded to the spa shell so as couple the sound vibration energy to the shell so that sound can be heard when using the spa.

8 Claims, 2 Drawing Sheets

SPA AUDIO SYSTEM

BACKGROUND OF THE INVENTION

1. Field of the Invention

The subject invention relates generally to spas and more particularly to an audio system utilizing a spa shell as a sound-generating device.

2. Description of Related Art

Existing spa audio systems use traditional speakers wherein the audio drivers are exposed to the harsh spa environment and/or require protection or esoteric materials to prevent premature failure. Existing spa audio systems also suffer from the limited space available to mount speakers. The resultant smaller speakers are incapable of reproducing full range audio (50 Hz–17 kHz).

SUMMARY OF THE INVENTION

According to the invention, a spa shell is employed as an audio driver with audio transducers mounted inside the skirt of the spa. The inventor has found that the spa shell provides both sufficient rigidity for high frequency reproduction and a sufficiently large surface area to achieve low frequency reproduction.

BRIEF DESCRIPTION OF THE DRAWINGS

The just summarized invention will now be described in detail in conjunction with the drawings of which.

DETAILED DESCRIPTION

Figure 1:
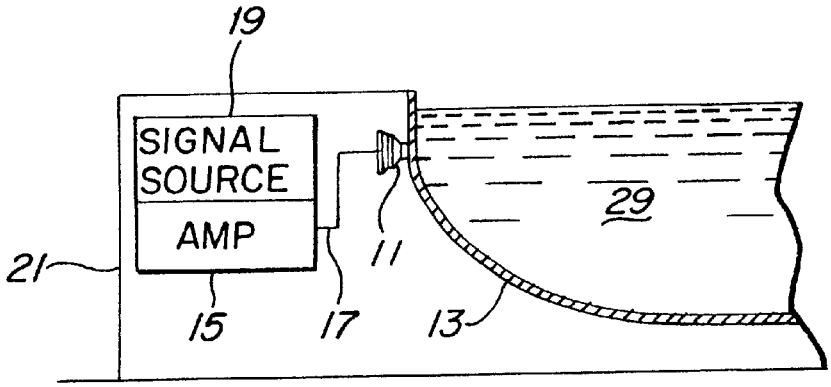
FIG. 1 is a schematic cross-sectional diagram illustrating a spa audio system according to the preferred embodiment.

FIG. 1 illustrates a spa audio system according to a preferred embodiment. According to this embodiment, audio transducer devices 11 are bonded to a spa shell 13. The transducer devices 11 couple the sound vibration energy so that sound can be heard when using the spa. Two transducer devices 11 are preferably provided for stereo effect but one device or more than two devices may also be used. The transducer devices 11 may be driven by a conventional integrated audio amplifier 15, providing e.g., 100–300 watts per channel.

The spa shell 13 is rigid enough to support the weight of water and bathers but is sufficiently compliant to reproduce full range audio. A typical spa shell 13 is formed of thermoset plastic or thermoplastic and has a thickness of 0.100–0.300 inches. Of course, other materials and dimensions providing the functional prerequisites for water/bather support and audio transmission may be employed.

Rigid engagement of each transducer device 11 to the spa shell 13 is required. The installation method preferably prevents spa insulation material from contaminating the transducer/shell coupling. This is achieved by constructing the transducer device 11 as a formed enclosure that surrounds a transducer element and installing it to the spa shell 13 before the insulation material is applied. A suitable audio transducer element is Model TST 329 as available from Clark Synthesis, Inc., 8122 S. Park Lane, Littleton, Colo. 80120.

Figure 2:
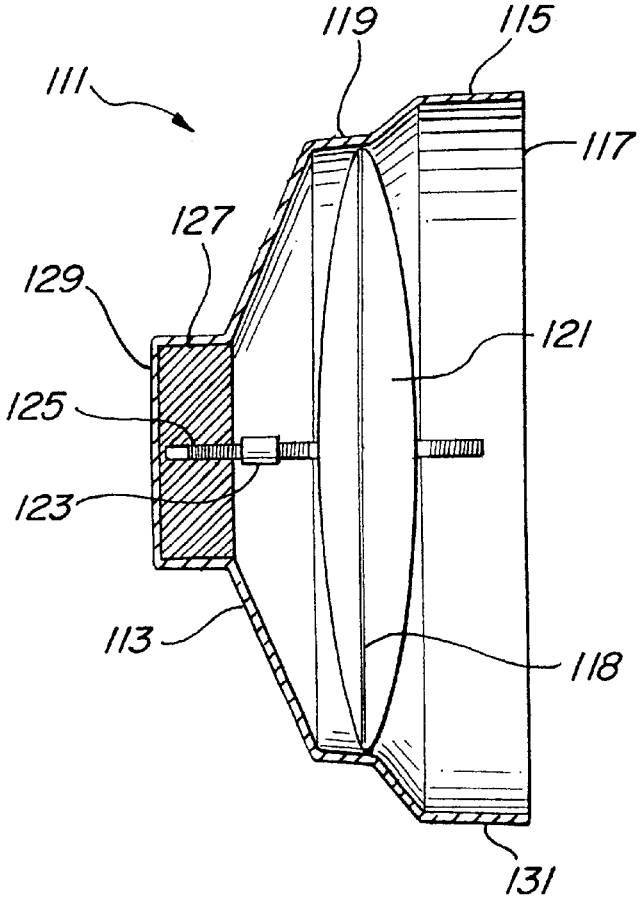
FIG. 2 illustrates an enclosure apparatus for attaching transducers to the spa shell.

An illustrative formed enclosure 111 is shown in FIG. 2. This enclosure 111 includes a thermoformed molded plastic housing 113, which may be fabricated, for example, from ⅛" ABS plastic. The housing 113 includes an outer cylindrical shell portion 115, which provides a circular rim or edge 117, which is open.

Adjacent the open rim 117 of the enclosure 111, a somewhat smaller concentric cylindrical portion 119 is provided, which is of a diameter selected to support the outer rim 118 of the transducer element 121. A nut 123 is threaded onto a threaded projection of the transducer 121 and receives a threaded end of a stud 125. The stud 125 threads into a cylindrical plug or puck 127 formed of plastic or metal at a closed end 129 of the housing 113, thereby attaching and further supporting the transducer 121 within the housing 113.

Attachment of the housing 113 and the cylindrical puck 127 to the spa shell 13 is preferably provided by gluing the end 129 of the housing 113 to the shell 13 (FIG. 1) foam could also be used. The puck 127 is then glued to the inside of the housing 113 at the closed end 129.

Additionally, support to the lower end 131 of the housing 113 may be provided, for example, via a brace attached to the spa frame structure at the lower end 131 of the housing in order to relieve any shear stress created by hanging the housing/transducer assembly off the side of the spa shell 13. A hatch or door in the spa skirt 21 (FIG. 1) may also be provided to access the speaker enclosures 111 through the open ended rim 117 of housing 113.

Figure 3:
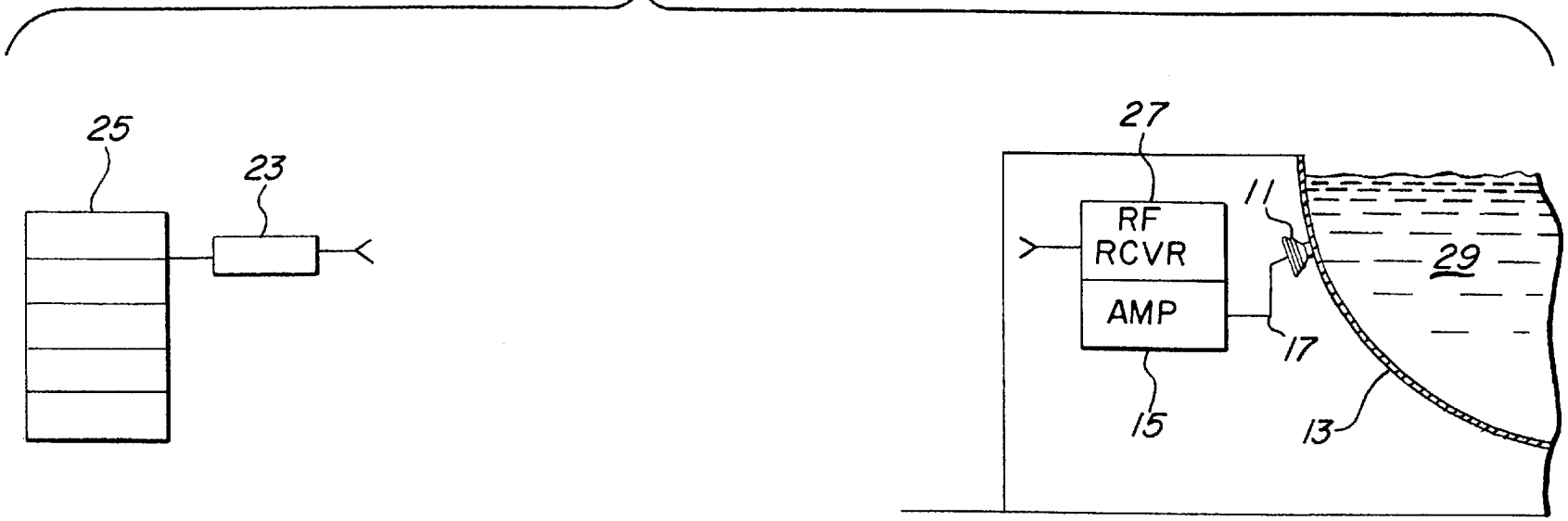
FIG. 3 is a schematic diagram of an alternate embodiment employing an RF transmitting device.

The output signal of the amplifier 15 may be coupled to the transducers via conventional speaker wire 17. In such case, the amplifier 15 and audio components 19 supplying it, such as preamplifiers and/or CD players, may be located in a compartment within the spa skirt 21 or elsewhere. Alternatively, as shown in FIG. 3, a remote transmitting device 23 (e.g., RF) may be used to enable use of a homeowner's home audio system 25 as the music signal source. Such remote transmitting devices are commercially available, for example, the 900 MHz or 2.4 GHz wireless receiver/transmitters provided by X-10 USA, Closter, N.J. 07624. In such case, a receiver 27 located at the spa provides the home audio signal to the amplifier 15, which then drives the transducers 11.

In operation, the audio can be heard under water 29 as well as above the water 29. Listeners outside the spa can also hear the audio signal, but the experience is muted compared to that of the tub occupant.

As may be appreciated, the preferred embodiment permits the audio transducer devices to be enclosed within the spa, providing improved aesthetics by eliminating exposed speaker locations. Enclosing the transducer devices within the spa also protects them from water and reduces the risk of water exposure to electrical signals.

From the above description, those skilled in the art will appreciate that various adaptations and modifications of the just-described preferred embodiments can be configured without departing from the scope and spirit of the invention. Therefore, it is to be understood that within the scope of the appended claims, the invention may be practiced other than as specifically described herein.

What is claimed is:

1. A spa audio system, comprising:

a spa shell;

a transducer enclosure closed at a first end and open at a second end; the enclosure attached to the spa shell at its closed first end; and a transducer mounted in the transducer enclosure for coupling sound vibration energy to the spa shell through the first end of the transducer enclosure.

2. The spa audio system of claim 1 further including an amplifier located adjacent to the spa shell for supplying an audio signal to the transducer in the enclosure.

3. The spa audio system of claim 1 further including radio frequency transmission means for transmitting a user home audio signal to a radio frequency receiver means located adjacent to the spa shell.

4. The spa audio system of claim 1 wherein the first end of the transducer enclosure is glued to the spa shell.

5. The spa audio system of claim 4 wherein the glue used to attach the transducer enclosure to the spa shell may be any one of the group consisting of ABS glue, fiberglass, permalite, or structural foam.

6. The spa audio system of claim 1 wherein the transducer enclosure is shaped to accommodate the transducer with the open second end being larger than the outer rim of the transducer, and the closed first end has a cylindrical plastic puck therein for attachment to the transducer.

7. The spa audio system of claim 1 wherein the spa shell is between 0.100–0.300 inches thick.

8. The spa audio system of claim 1 wherein the spa shell is made of thermoplastic.

* * * * *